US006661112B2

(12) United States Patent
Zeier et al.

(10) Patent No.: US 6,661,112 B2
(45) Date of Patent: Dec. 9, 2003

(54) FLUID CONTROL SYSTEM WITH AUTOMATIC RECOVERY FEATURE

(75) Inventors: Bruce E. Zeier, Romoland, CA (US); Anthony Chan, Sierra Madre, CA (US)

(73) Assignee: Bravo Zulu International, Grand Cayman (KY)

( * ) Notice: Subject to any disclaimer, the term of this patent is extended or adjusted under 35 U.S.C. 154(b) by 52 days.

(21) Appl. No.: 10/114,970

(22) Filed: Apr. 2, 2002

(65) Prior Publication Data

US 2002/0140233 A1 Oct. 3, 2002

Related U.S. Application Data

(60) Provisional application No. 60/281,545, filed on Apr. 2, 2001.

(51) Int. Cl.[7] ..... F03B 13/00
(52) U.S. Cl. ..... 290/43; 290/54; 290/52
(58) Field of Search ..... 290/43, 54, 52; 322/35, 20

(56) References Cited

U.S. PATENT DOCUMENTS

| | | | | | |
|---|---|---|---|---|---|
| 3,097,762 | A | | 7/1963 | Charnota et al. | |
| 3,589,126 | A | * | 6/1971 | Zotto | 60/664 |
| 3,756,461 | A | | 9/1973 | Duwez | |
| 3,898,794 | A | * | 8/1975 | Ariga | 60/39.181 |
| 4,202,467 | A | | 5/1980 | Rutten et al. | |
| 4,335,852 | A | | 6/1982 | Chow | |
| 4,352,025 | A | * | 9/1982 | Troyen | 290/54 |
| 4,496,845 | A | * | 1/1985 | Ensign et al. | 290/43 |
| D287,043 | S | | 12/1986 | Hughes | |
| 4,746,808 | A | * | 5/1988 | Kaeser | 290/52 |
| 4,903,731 | A | | 2/1990 | Pappy | |
| 4,918,369 | A | * | 4/1990 | Solorow | 322/35 |
| 4,941,771 | A | * | 7/1990 | Perper | 405/78 |
| 5,125,120 | A | | 6/1992 | Baron | |
| 5,207,354 | A | | 5/1993 | Hsu et al. | |
| 5,850,733 | A | * | 12/1998 | Bosley et al. | 60/39.464 |
| 6,006,779 | A | | 12/1999 | Nowlin | |
| 6,447,243 | B1 | * | 9/2002 | Kittle | 415/92 |

FOREIGN PATENT DOCUMENTS

| | | | | |
|---|---|---|---|---|
| JP | 5799277 A | * | 6/1982 | |
| JP | 57126564 A | * | 8/1982 | F03B/3/04 |
| JP | 5818568 A | * | 2/1983 | |
| JP | 07158406 A | * | 6/1995 | F01D/21/00 |

* cited by examiner

*Primary Examiner*—Joseph Waks
(74) *Attorney, Agent, or Firm*—Gene Scott-Patent Law & Venture Group

(57) ABSTRACT

A fluid control method includes providing fluid flow through a conduit having a pressure sensitive shutdown valve; driving an electrical power generator with the turbine wheel and delivering electrical power to a storage battery which in-turn powers the components of the system. The method further includes: detecting turbine RPM; calculating volume flow rate from the RPM value and conversion factors input to a computer program. Next, it is determined if average or peak flow rates exceed set point values and creating a shut down signal if it is true so as to close the shutdown valve. A fluid pressure delta is therefore established across the shutdown valve and it is only opened when fluid pressure equilibrium is restored across the valve after break or leak repair and after slowly refilling the downstream system.

2 Claims, 1 Drawing Sheet

FLUID CONTROL SYSTEM WITH AUTOMATIC RECOVERY FEATURE

RELATED APPLICATIONS

This application claims priority from a provisional application, serial No. 60/281,545 filed on Apr. 2, 2001.

BACKGROUND OF THE INVENTION

1. Field of the Invention

This invention relates generally to fluid control systems and more particularly to a water control system for assuring an average and a peak water flow through a system.

2. Description of Related Art

The following art defines the present state of this field:

Hughes, U.S. Des. Pat. No. 287,043 describes an automatic fluid shutoff valve design.

Charnota et al., U.S. Pat. No. 3,097,762 describes a liquid metering valve unit comprising in combination, a casing having formed therein an inlet, an outlet, and an impeller chamber interposed between said inlet and said outlet and in communication therewith, a valve seat formed on the interior portion of said outlet, a valve member coacting with said valve seat to control fluid flow through said outlet, means mounting said valve member for movement between open and closed positions, means acting on said mounting means biasing said valve member toward closed position, a quick snap locking mechanism having a pair of coaxial, relatively rotatable elements operable to control the movement of said valve member to closed position, the first of said elements being connected to said valve member mounting means and being movable axially and rotatably to move said valve member to open position, the second of said elements being movable only rotatably, means releasably interconnecting said elements, an impeller wheel rotatably mounted in said impeller chamber and driven by the flow of liquid through said inlet and said impeller chamber, and speed reducing gearing interposed between and connected to said impeller wheel and said second locking mechanism element to rotate the latter and said first element into a locking position at a rate of speed greatly reduced from that of said impeller wheel.

Duwez, U.S. Pat. No. 3,756,461 describes a device for predetermining the quantities of liquid delivered by a meter, said meter having a valve to control the delivery and means for measuring the quantity of liquid delivered, comprises a rotatable cam and a transmission having a variable transmission ratio adapted to be driven by said quantity measuring means for rotating said cam. A valve closure-controlling lever having a portion engagable with said cam is arranged for closing said valve in at least one angular position of said cam upon completion of a constant angular displacement by said cam from a stop position. A selector is provided for choosing a desired transmission ratio and thus selecting a predetermined quantity of liquid to be delivered while the cam rotates through said constant angular displacement. The lever is temporarily inhibited from on the valve upon opening of said valve to rotate said cam from said at least one angular position through said constant displacement thus permitting the start of a new delivery of the same predetermined quantity by just opening the valve.

Rutten et al., U.S. Pat. No. 4,202,467 describes a volumetric valve, which supplies a displayed liquid volume. This valve has a turbine which is rotated by the liquid and which drives a disk via a gear train. The disk rotates a spiral spring and a ring provided with a slot. A sliding push rod controls the opening of the valve flap and carries a lug, which penetrates the slot. A knob makes it possible to vary the angular clearance between the slot and the lug, which determines the displayed volume.

Chow, U.S. Pat. No. 4,335,852 describes a device to control the flow of fluid using a cam and ratchet wheel. A valve is operated by the cam portion of the wheel, which bears against the valve stem causing it to open. Fluid flow causes a pawl to drive the ratchet portion of the wheel, rotating the wheel until the valve stem bears against a low point in the cam, permitting the valve to close. A part of the ratchet portion does not contain ratchet teeth, in which area the pawl cannot drive the wheel. In this area, the cam has an increasing radius from a radius corresponding to a closed valve, to a radius corresponding to a fully open valve. This permits manual control of fluid flow without disengagement of the device.

Pappy, U.S. Pat. No. 4,903,731 describes a water closet valve, automatically closed, following the passage of a predetermined quantity of water therethrough, including a cylindrical housing having an inlet valve and water passageway at its depending end, is mounted within a water closet on its bottom wall. A manually triggered control wheel unseats the valve by a cam surface on the control wheel which permits water to enter the cylindrical housing and drive a water wheel, in turn driving a gear train connected with the control wheel for angular rotation of the control wheel and its camming surface to a valve closed position after a predetermined number of revolutions of the gears of the gear train.

Baron, U.S. Pat. No. 5,125,120 describes a toilet water regulator device which prohibits water flow into the toilet system after a predetermined amount of water has entered the system comprising a valve at the water inlet to the system, said valve having a water outlet to the system, wherein the flow of water through said valve is controlled by turbine means associated with the water outlet of the valve and the amount of water predetermined necessary to fill the tank is controlled by adjustable valve means.

Hsu et al., U.S. Pat. No. 5,207,354 describes a valve suitable for lawn and garden irrigation with a fluid inlet and two fluid outlets and a means for switching the flow of water from one outlet to the other based upon a predetermined flow of water. A plurality of valves may connected in series to irrigate several garden areas by connecting the inlet of each valve with the second outlet of the previous valve, except the inlet of the first valve which communicates with a water source.

Nowlin, U.S. Pat. No. 6,006,779 describes a fluid cutoff system for preventing fluid flow through a hose whenever a desired amount of fluid has been deposited onto an area comprising a tube having a valve therein. An accumulator has a float floatably disposed therein with an extension attached to the float. The extension interacts with the valve such that whenever the float is in a relatively low position the extension holds the valve in an open position and whenever the float is in a relatively high position—corresponding to fluid being deposited in the accumulator—the extension disengages from the valve and the valve closes and prevents water flow through the tube.

The prior art teaches fluid flow shut-down devices, metering units, volume displays with resets, fluid controls, water fill shutoff systems, regulators and diverters, but does not teach a system devised to assure that average and/or peak flow is maintained, and that will shut down flow that exceeds such and will not start until a trouble condition is repaired.

The present invention fulfills these needs and provides further related advantages as described in the following summary.

SUMMARY OF THE INVENTION

The present invention teaches certain benefits in construction and use which give rise to the objectives described below.

The present invention is a method and apparatus for controlling fluid flow in a pipe system to avoid problems associated with down-stream flooding due to leaks and breaks such as might occur due to earthquakes, system wear and other similar problems. During normal fluid flow through a conduit a shutdown valve is open. The fluid control method includes providing fluid flow through the conduit having a pressure sensitive shutdown valve; driving an electrical power generator with the turbine wheel and delivering electrical power to a storage battery which in-turn powers the components of the system. The method further includes: detecting turbine RPM; calculating volume flow rate from the RPM value and conversion factors input to a computer program. Next, it is determined if average or peak flow rates exceed set point values and creating a shut down signal if it is true so as to close the shutdown valve. A fluid pressure delta is therefore established across the shutdown valve and it is only opened when fluid pressure equilibrium is restored across the valve after break or leak repair and after slowly refilling the downstream system. The generator produces the electrical current to operate the system.

A primary objective of the present invention is to provide an apparatus and method of use of such apparatus that provides advantages not taught by the prior art.

Another objective is to provide such an invention capable of automatic operation when a fluid system ruptures or when operating parameters are outside of specification.

A further objective is to provide such an invention capable of generating operating power for monitoring and control devices.

A still further objective is to provide such an invention capable of automatically restarting system flow depending on pressure differential at a shutoff valve.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawing illustrates the present invention. In such drawing.

DETAILED DESCRIPTION OF THE INVENTION

Figure 1:
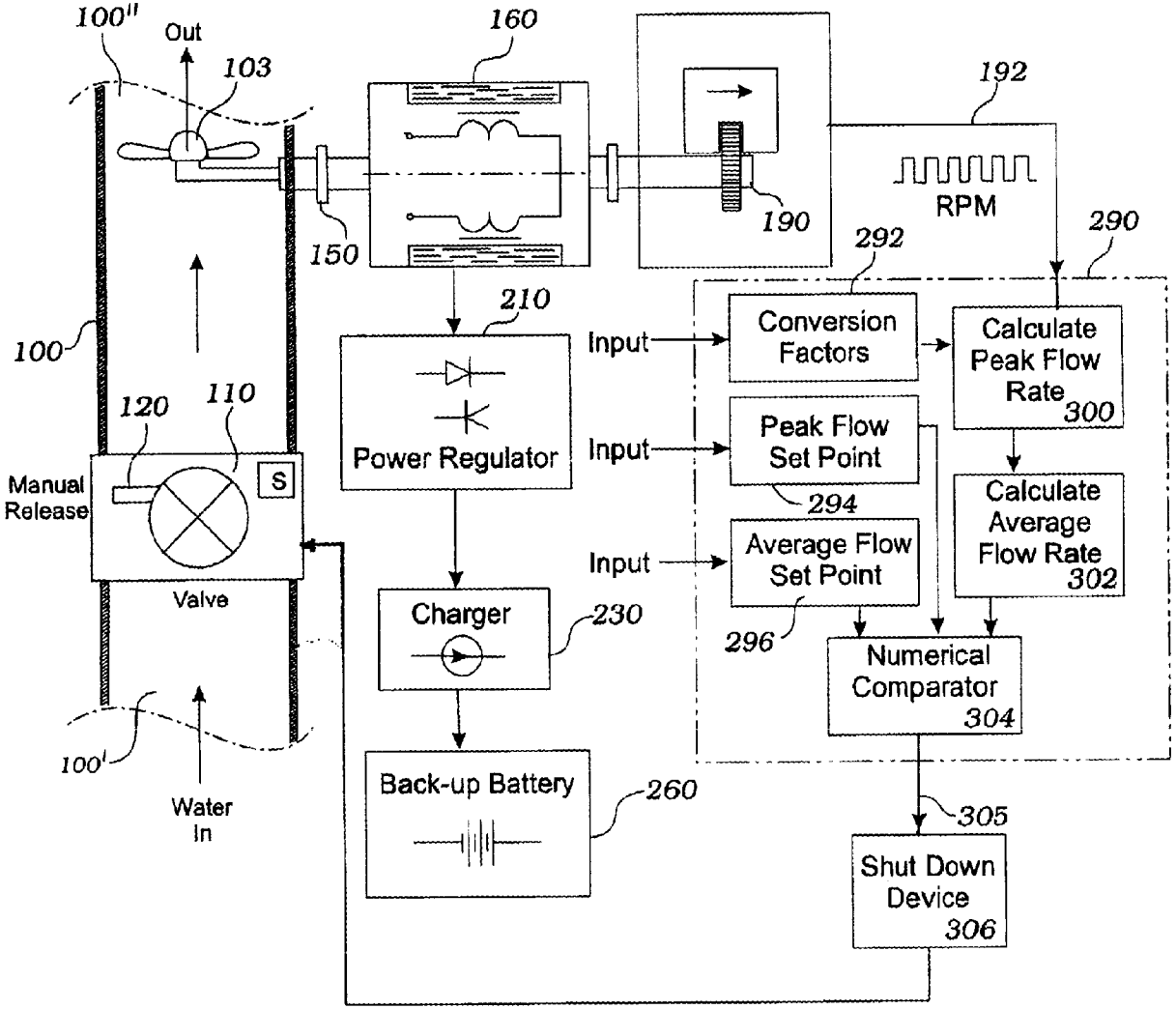
FIG. 1 is a schematic diagram of the method of the invention.

The above described drawing figures illustrate the invention in at least one of its preferred embodiments, which is further defined in detail in the following description.

The present invention is a fluid control method for use in industrial, municipal and commercial applications. The method includes providing fluid flow through a conduit 100 which includes a shutdown valve 110. Such a conduit 100 is preferably a water pipe or the equivalent. The conduit 100 is fixtured with a turbine wheel 103 driven by the fluid flowing in the conduit 100. This drives, as shown in FIG. 1, an electrical power generator 160 through coupling 150, so as to deliver electrical power to a storage battery 260 which requires current rectification, filtering and other well known steps as shown in block 210 of the figure, and such current is provided through a charging device 230 as is also well known. Fluid flow is monitored by sensing turbine wheel RPM, and this may be accomplished using electronic, optical or magnetic devices, as is well known in the art. Any one of devices 190 is configured to output a pulse signal 192 representative of the RPM being sensed. This pulse signal is input to a computer 290 having a logic program as shown in the figure. Conversion factors 292, for calculating actual peak and average flow rates are input to the logic program as well.

As an example, by trial, for a given fluid it can be determined that a given volume of such fluid, measured in units of volume, will turn the turbine wheel 103 at a certain rate. Therefore, knowledge of rotations immediately yields information about the volume of such fluid that has passed the turbine. Such conversion factor 292 is determined by trial and input to the logic program as shown. Thus when pulses 192 are received, volume of flow is calculated as units of volume per unit time, since the program has access to a time base in the computer device.

Two set points are input as well, one for the maximum instantaneous flow rate, and this is known as peak volume; the other set point is for the maximum desirable or average flow rate, as for instance, in one minute, five minutes, one hour, etc. It is clear from the foregoing that the many water distribution systems must be monitored for peak and average flow and that it is desirable to prevent excess flow which may be dangerous to life or property. Clearly, the objective here is to sense when a break in the downstream water system has occurred, which would immediately cause massive flow through the conduit 100, and to sense when leakage is occurring down stream, which will cause the amount of flow over a longer time to become excessive.

Using the conversion factors, peak flow rate is calculated at 300 and average flow rate is calculated at 302, and these values are compared with the set points 294 and 296 respectively as represented by the numerical comparator 306, a common step in computer logic flow. A signal is generated at 305 and input into shut-down device 306 which is preferably a device for generating a voltage usable for closing a relay or the equivalent to actuate the valve 110 to close it down.

When this occurs, fluid pressure raises in the upstream portion 100' of conduit 100 while in the downstream portion 100" pressure drops due to a line break or leak. A bypass feature 120 which may be a bypass valve or part of the shutdown valve 110 itself, is then opened manually, assuming any leaks or breaks in the downstream portion 100" have been repaired, and a restricted flow of the fluid starts to move downstream. This flow may be used for leak checking and other maintenance work. When the downstream portion 100" of conduit 100 is filled, the pressure drop across the shutdown valve 110 reaches zero and the shutdown valve opens automatically restoring normal operation to the system. This is accomplished by sensor S, a part of the valve 110, and such automatic operation depending on pressure sensing is well known in the art, in general. It is noted that power for operating all of the devices of this invention is derived from the battery 260 or from the generator 160 directly. These power line connections are not shown in the figure for clarity.

In the above we have established a method and defined means for calculating average and peak flow rates in the conduit; means for determining if average or peak flow rates exceed set point values; means for producing a shut down signal when average or peak set point values are exceeded; means for closing the shutdown valve when average or peak set point values are exceeded thereby establishing a pressure drop across the shutdown valve; means for enabling a bypass flow in the shutdown valve so as to enable fluid pressure equilibrium across the shutdown valve, automation means for opening the shutdown valve when said equilibrium is achieved so as to restore said fluid flow through the conduit.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A control method in a fluid system comprising the steps of: providing fluid flow through a conduit having a fluid shutdown valve; driving a turbine wheel with the fluid flowing in the conduit; driving an electrical power generator with the turbine wheel; delivering electrical power from the generator to a storage battery; detecting turbine wheel RPM; calculating actual peak and average flow rate from the RPM and input conversion factors; determining if one of average actual and peak actual flow rates exceed set point values; producing a shut down signal if average or peak set point values are exceeded; closing the shutdown valve with the shut down signal, thereby establishing a pressure drop across the shutdown valve; enabling a bypass flow; sensing when fluid pressure equilibrium across the shutdown valve is reached, opening the shutdown valve when said equilibrium is achieved thereby restoring said fluid flow through the conduit.

2. A control apparatus in a fluid system comprising: a conduit for receiving a fluid flow, the conduit having a fluid shutdown valve; a turbine wheel positioned within the conduit and driven by the fluid flowing in the conduit; an electrical power generator engaged with and driven by the turbine wheel for delivering electrical power from the generator to a storage battery; a detector enabled for detecting turbine wheel RPM; means for calculating average and peak flow rates in the conduit; means for determining if average or peak flow rates exceed set point values; means for producing a shut down signal when average or peak set point values are exceeded; means for closing the shutdown valve when average or peak set point values are exceeded thereby establishing a pressure drop across the shutdown valve; means for enabling a bypass flow in the shutdown valve so as to enable fluid pressure equilibrium across the shutdown valve, automation means for opening the shutdown valve when said equilibrium is achieved so as to restore said fluid flow through the conduit.

* * * * *